US006527088B1

(12) United States Patent
Fowler

(10) Patent No.: US 6,527,088 B1
(45) Date of Patent: Mar. 4, 2003

(54) LIFT APPARATUS FOR TRANSPORTING PACKAGES BETWEEN TWO OR MORE FLOORS OF A BUILDING

(76) Inventor: David W. Fowler, 24956 Wolf Bay Ter., Orange Beach, AL (US) 36561

( * ) Notice: Subject to any disclaimer, the term of this patent is extended or adjusted under 35 U.S.C. 154(b) by 152 days.

(21) Appl. No.: 09/748,930

(22) Filed: Dec. 27, 2000

(51) Int. Cl.[7] ..... B66B 9/00

(52) U.S. Cl. ..... 187/239; 187/254; 187/264; 187/266

(58) Field of Search ..... 187/239, 251, 187/254, 266, 264, 401; 182/103, 132

(56) References Cited

U.S. PATENT DOCUMENTS

| | | | | | |
|---|---|---|---|---|---|
| 691,775 | A | * | 1/1902 | Joyce | 187/239 |
| 1,312,089 | A | | 8/1919 | Anderson | |
| 3,088,545 | A | * | 5/1963 | Meyer | 187/239 |
| 3,344,885 | A | | 10/1967 | Rasmussen | 182/16 |
| 3,517,774 | A | | 6/1970 | Meyer | 187/6 |
| 3,796,285 | A | | 3/1974 | Grebenstein | 187/20 |
| 3,891,062 | A | | 6/1975 | Geneste | 187/10 |
| 4,183,423 | A | | 1/1980 | Lewis | 182/103 |
| 4,262,773 | A | | 4/1981 | Basham | 182/132 |
| 4,467,889 | A | | 8/1984 | Maubach et al. | 182/103 |
| 4,469,198 | A | | 9/1984 | Crump | 187/8 |
| 4,491,196 | A | | 1/1985 | Bocker | 187/10 |
| 4,546,854 | A | | 10/1985 | Bocker | 182/103 |
| 4,875,547 | A | | 10/1989 | Hanthorn | 182/102 |

FOREIGN PATENT DOCUMENTS

| | | | | |
|---|---|---|---|---|
| DE | 544639 A | * | 2/1932 | 187/239 |
| FR | 1302671 A | * | 7/1962 | 187/251 |
| IT | 638960 B | * | 4/1962 | 187/239 |

* cited by examiner

*Primary Examiner*—Donald P. Walsh
*Assistant Examiner*—Thuy V. Tran
(74) *Attorney, Agent, or Firm*—Wyatt, Tarrant & Combs, L.L.P.

(57) ABSTRACT

A vertically extended loading and unloading apparatus spans between the floors of a building. The apparatus includes a frame that is generally vertically positioned, the frame extending between at least two floors of a building so that articles to be loaded or unloaded between floors can be transported vertically using the frame. A carriage is movably mounted to the frame, the carriage having an interior and an upper planar load carrying horizontal surface and a plurality of inclined side walls that extend from the load carrying horizontal surface downwardly. A motor drive mounted inside the carriage interior engages a static belt that is wound upon the motor drive and anchored at the top and bottom of the frame. The cable extends horizontally to engage the motor drive and a gear provided on the motor drive within the carriage interior. Rotation of the gear in the opposite directions defines either upward or downward movement of the carriage.

20 Claims, 5 Drawing Sheets

LIFT APPARATUS FOR TRANSPORTING PACKAGES BETWEEN TWO OR MORE FLOORS OF A BUILDING

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lifting devices for transporting packages (groceries, luggage, light supplies, and the like) between two or more floors of a building. Even more particularly, the present invention relates to an improved lift apparatus that features a specially configured housing that lifts packages (eg. using a removable tray) from a ground floor to an upper floor, wherein the housing contains a drive motor that engages a belt (preferably static) that is contained within an elongated vertical support rail.

2. General Background of the Invention

Compact lifting devices are known that are constructed as part of a home, condominium, or like construction. These commercially available devices are typically referred to as "dumb waiters", designed to carry objects between the ground level and upper level (or levels) of a home, condominium, apartment, small building, or the like. However, conventional dumb waiters consume valuable floor space inside a dwelling. Further, they typically can only be supplied to a home during construction. Retrofit can be very expensive and in some cases, virtually impossible.

Many patents have issued that are directed to lifting devices, some of which are adapted to be used on the outside of a structure such as an apartment, condominium, home or the like. An early example of such a patent is U.S. Pat. No. 1,312,089 entitled "Elevating Truck".

A personnel lift is the subject of U.S. Pat. No. 3,344,885 issued to E. E. Rasmussen.

An elongated, vertically extended lifting arrangement is seen in the Meyer U.S. Pat. No. 3,517,774 entitled "Tower Elevator". In the '774 patent, power is supplied to a lower pulley assembly by a reversible motor housed within a removable power unit.

A load raising and lowering apparatus is the subject of U.S. Pat. No. 3,796,285. The apparatus includes a load supporting platform which is suspended on a pair of chains and is movable between an extreme upper and an extreme lower position. The pair of chains are positioned about an upper pair of sprockets and a lower pair of sprockets. The two ends of each chain are connected to the platform. The upper end of each chain is directly connected to respective sides of the platform. The lower end of each chain is connected, via respective springs, to the respective sides of the platform at points below those points to which the respective upper ends of the chains are connected. The spring constants of the springs are at least approximately equal to the spring constants of the respective chains.

U.S. Pat. No. 3,891,062 issued to Geneste provides a mobile lift made up of a rectilinear guide adjustably held in upward inclined position by a support having a base of which the end is wheel-mounted so that the lift may be displaced. A load carrier is movably mounted on the said guide and a cable, of which one end is secured on the carrier and the other winds around a mechanical winch after having wound around a pulley, allows displacement of the carrier on the guide.

In U.S. Pat. No. 4,183,423, there is provided a ladder hoist that includes a cart bolted to a short section of a ladder that carries a winch. A cable on the winch runs over a pulley on a short top section of the ladder and is connected to a carriage having wheels running in channel-like side members of the ladder. The carriage has an adjustable, folding platform and a back which pivots to a horizontal position when the carriage reaches the top of the ladder. A bottom pushbutton control and a top pushbutton control are provided.

A self-contained scaffold and lift unit is disclosed in U.S. Pat. No. 4,262,773. The '773 patent lift unit includes first and second pairs of parallel, spaced apart vertical rails joined together by horizontal braces. A movable lifting carriage unit is disposed between the pairs of vertical rails and includes pairs of rollers engaging and captured between the pairs of vertical rails to provide smooth vertical motion with respect to the rails. A primary load-bearing platform is removably attached to a lower portion of the carriage unit and an auxiliary load-bearing platform is removably attached to an upper portion of the carriage unit. A manually driven hoist is attached to the carriage to allow controlled movement. The carriage unit is positioned with respect to the rails by the hoist. An auxiliary base assembly is removably mounted to the scaffold unit to secure the scaffold unit in an erect and freestanding manner. The rigid scaffold units are assembled in modular interfitting sections to allow a scaffold of any desired height to be formed.

A service elevator is disclosed in U.S. Pat. No. 4,467,889 that is designed to carry persons up or down, along a building wall or other structure. The apparatus comprises a ladder secured to that structure and a carriage on which an endless conveyor band is supported. The band has projecting dogs engaging the rungs of the ladder which are held between a first stringer of circular cross-section and a second stringer of rectangular cross-section. The band-supporting frame has sleeves slidably engaging the first stringer and roller pairs bracketing the second stringer. A second conveyor band, serving as a standby for the working band, co-rotates therewith and has dogs slightly offset from those of the latter for dropping onto the rungs when the working band fails.

In the Crump U.S. Pat. No. 4,469,198, there is disclosed an outside rescue elevator system for high-rise buildings. As part of this apparatus, an elongated, vertically extended rail or track is provided with a portable elevator cab which is usually coupled to the track system only during an emergency situation.

The Böcker U.S. Pat. No. 4,491,196 discloses a telescopic beam for use in an inclined hoist that has five telescopic members. An actuator comprising a motorized winch and a block and tackle arrangement is provided for extending the telescopic members relative to one another. The block and tackle arrangement includes a cable which passes several times around sets of rollers positioned at the adjacent ends of first and second of the telescopic members. A lock is provided for fixing the positions of the first and second telescopic members. To relieve the operator of the need for controlling several actuators, the single actuator is used to control the extension of all the telescopic members, and to control the angle of inclination of the last telescopic member relative to the penultimate telescopic member. For this purpose, the cable is passed from the second telescopic member to the far end of the penultimate telescopic member, and then to the adjacent end of the last telescopic member where it is secured.

Another Böcker U.S. Pat. No. 4,546,854 discloses a load carrying platform particularly useful in moving furniture along an inclined elevator. The load carrying platform is supported by a carriage which is movable along guide rails of the elevator. Telescopic guides are provided between the carriage and the base of the platform, so that the platform is displaceable in relation to the carriage. Thus, when the unloading position is reached, the platform can be moved, at least partially, through a window opening and into the interior of a house.

U.S. Pat. No. 4,875,547 discloses a portable conveyor system with telescopic boom assembly and load carrying apparatus.

An automatic loader and unloader is disclosed in the Heisler U.S. Pat. No. 4,148,404. The apparatus includes a stationary frame, a main carriage movable in either direction relative to the stationary frame, and a coupler carriage movable in either direction relative to the main carriage. The main carriage is slidably disposed on the stationary frame by a bearing arrangement which provides a cantilever support for the main carriage when the main carriage is extended. The main carriage and the coupler carriage are extended and retracted by two pair of cables. One pair of cables effects movement of the main carriage and coupler carriage in one direction, and the other pair of cables effects movement of the main carriage and coupler carriage in the other direction.

BRIEF SUMMARY OF THE INVENTION

The present invention provides an improved lift apparatus that has particular utility in the lifting of packages such as groceries, luggage, supplies and like objects between the different floors of a residential structure such as a home, condominium, apartment or the like.

The present invention thus embodies a lightweight duty lift for a condominium, apartment, home or similar two or three story building. The apparatus is to be installed on the exterior of the building, reaching from a ground floor to a landing, gallery, porch or window on an upper floor.

The construction of the apparatus includes a lift frame having a platform, preferably with side rails and cabinet panels which cover an internal cavity of the lift frame housing. The internal cavity contains a motor drive.

The lift frame housing raises and lowers on a vertically positioned rail or track. In the preferred embodiment, the track is in the form of an enclosed channel having an exposed slot. This slot enables the motor to access a static belt or chain that is housed within the rail or track. Only a portion of the belt or chain extends through the slot to engage a pulley or gear shaft mounted to the motor drive. In this fashion, the motor rotates in order to lift itself upward to elevate objects from the ground floor to the first floor. For downward movement, the motor drive simply reverses direction so that it pulls itself along the belt toward the lower end of the belt.

With the present invention, the belt is not an endless chain but rather a static, yet flexible member mounted within the track. The belt flexes along its length as the motor drive travels up and down the length of the belt. Slider blocks equipped with pulleys are attached to the lift platform but extend through the slot to the interior of the channel. In this fashion, the slider blocks form an interface between the belt, the rail and the motor drive.

Various walls of the lift platform housing are preferably configured in a tapered (eg inverted pyramid) shape to urge objects aside which might be contacted in the downward movement approaching the ground.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
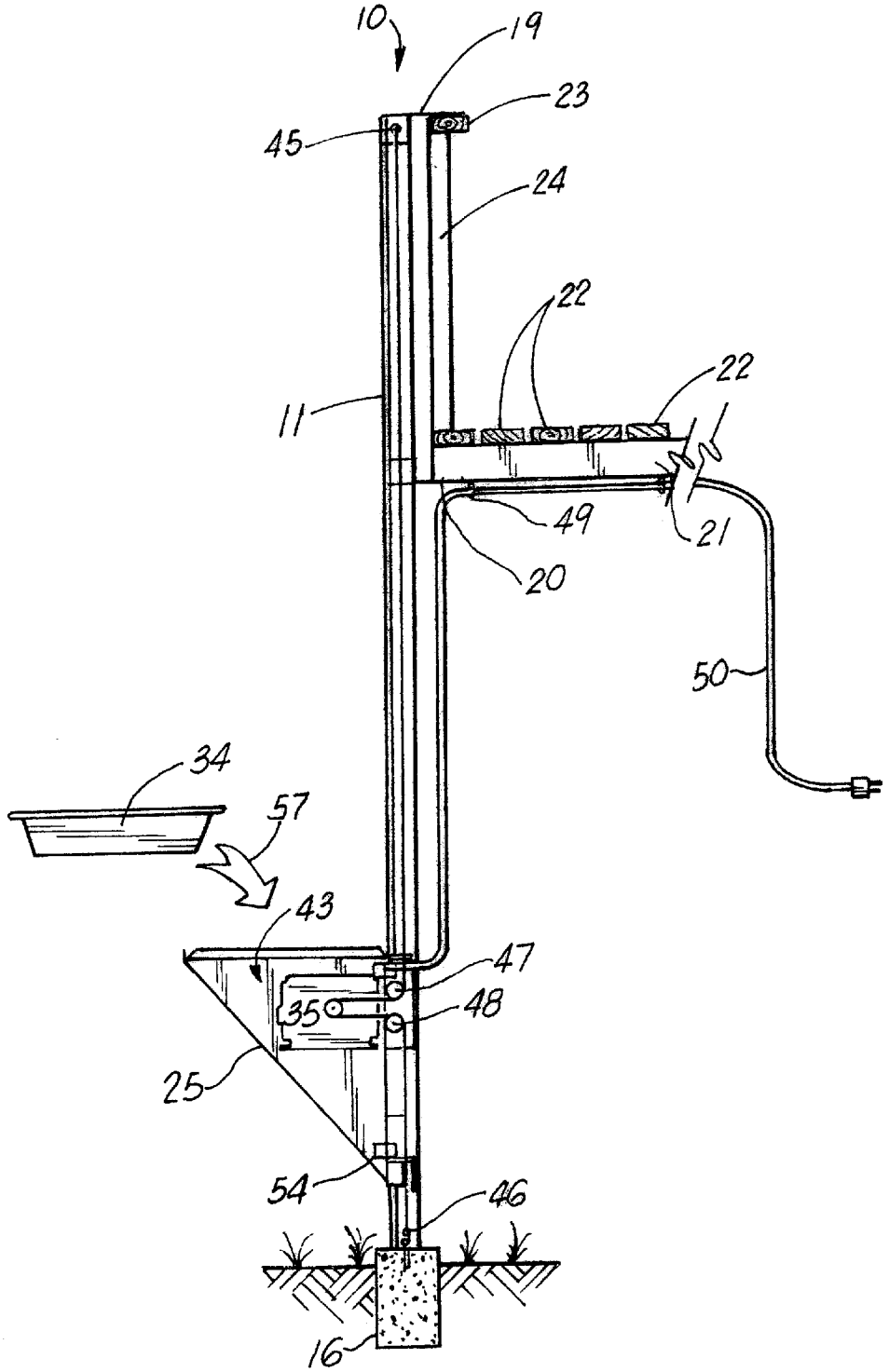
FIG. 1 is a side elevation view of the preferred embodiment of the apparatus of the present invention.
Figure 2:
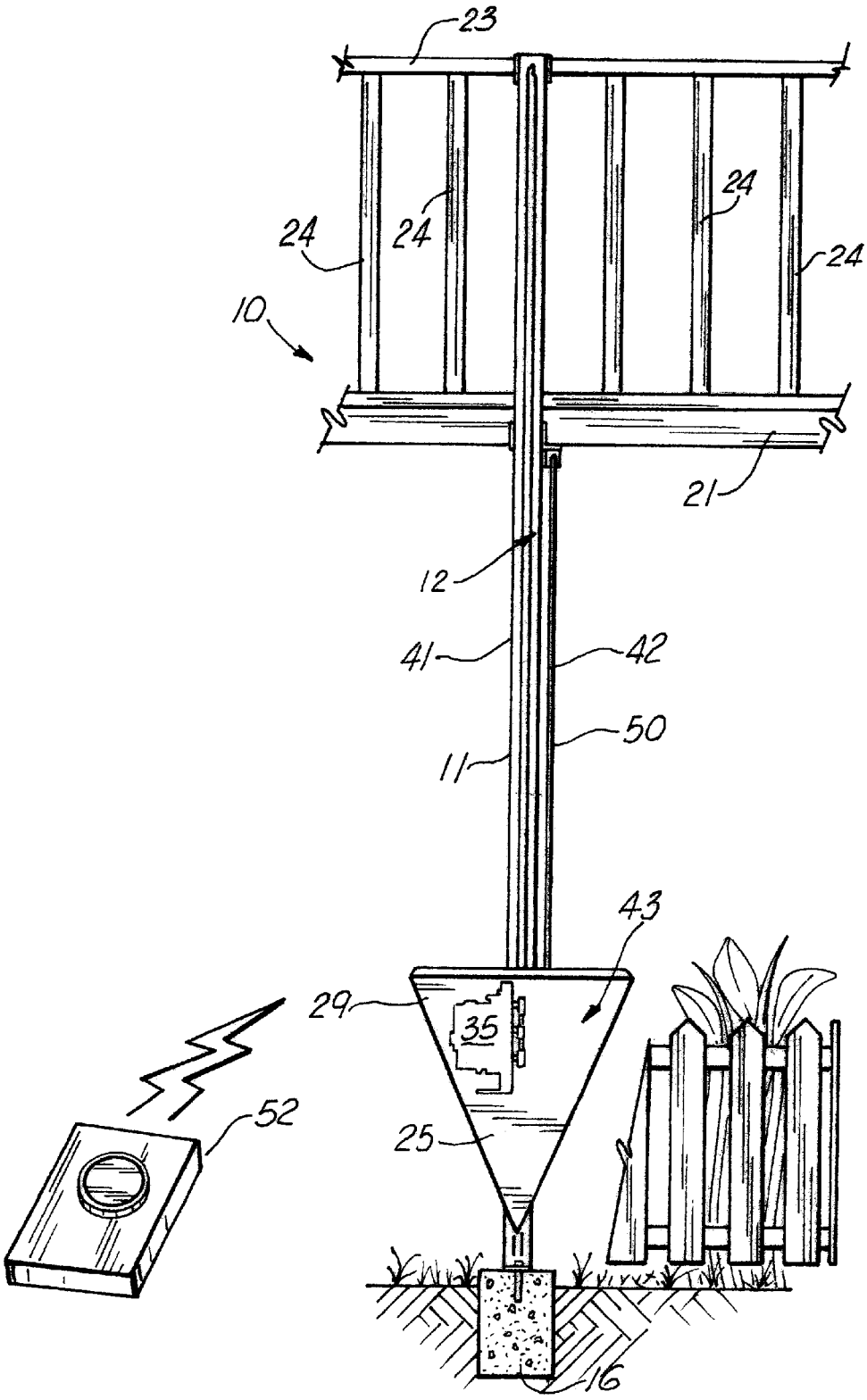
FIG. 2 is a front elevation view of the preferred embodiment of the apparatus of the present invention.
Figure 3:
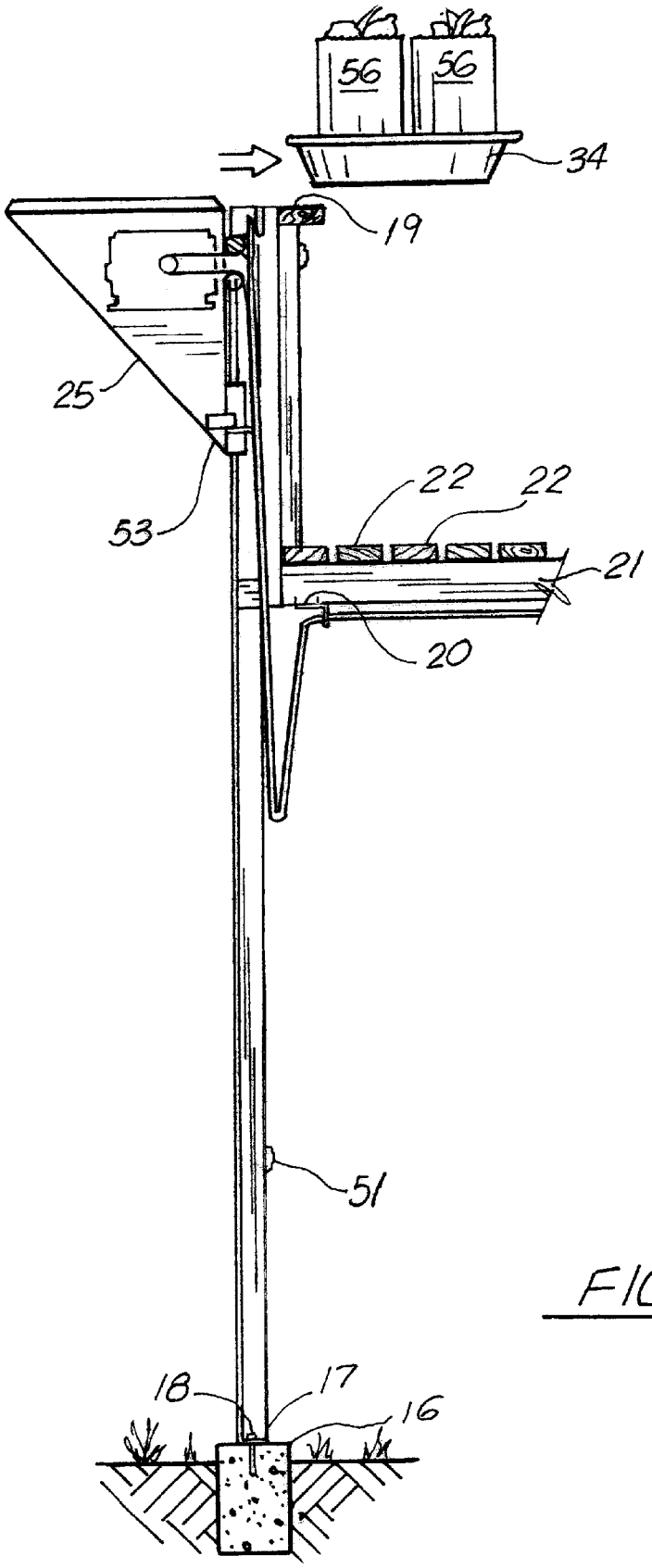
FIG. 3 is another side elevation view of the preferred embodiment of the apparatus of the present invention illustrating the housing in an elevated position and schematically illustrating removal of the tray with its contained packages.

Lift apparatus 10 is shown in FIGS. 1–3 as including a vertical rail 11 that extends between a selected first floor (eg. ground floor level) and a selected second floor level such as for example a deck, porch, gallery or the like. The apparatus 10 of the present invention is thus designed to be fitted to the exterior of a home, condominium, apartment, small building or the like.

Vertical rail 11 extends between a first level in FIG. 1 at footing 16 to define its lowermost position, upwardly to the first (or second) floor. Rail 11 is attached with top support 19 to railing 23 and/or to deck flooring 22, which can be a first or second floor of a condominium, home, apartment, building or the like.

The rail 11 provides an elongated slot 12 that enables communication between the interior 44 of rail 11 and motor drive 35 contained within housing 25.

The rail 11 can be in the form of a slotted channel beam that is square or rectangular, for example, in transverse cross section, having a plurality of flanges 13–15, 41, 42. The flanges can include rear flange 13, side flange 14 and side flange 15. In addition, the smaller front flanges 41, 42 are positioned on opposing sides of slot 12.

Vertical rail 11 can be supported upon a concrete footing 16 or other suitable structural footing or foundation. Rail 11 provides a transverse bottom plate 17 that can be attached to footing 16 using a suitable (eg. bolted) connection 18.

A pair of additional supports are provided for supporting rail 11. These include top support 19 that can be attached to the building, such as for example at railing 23 of the building's deck. Deck flooring 22 is shown in FIGS. 1 and 3. A middle support 20 can be attached to the deck area at deck beam 21 as shown in FIG. 1. Other structure of the deck can be used to provide an attachment between the upper end portion of rail 11 and the building to which the apparatus 10 is attached. Other attachments can be used to suit a particular building, such as for example, welded connections, bolted connections, and/or additional structural framing and/or trusses to form an interface between rail 11 and the building to which the apparatus 10 is to be attached.

In FIGS. 1–3, the deck includes deck beams 21, deck flooring 22, horizontally extending railing 23, and a plurality of spindles 24. While the attachments to the deck area shown in FIGS. 1–3 include only attachments using top support 19 and middle support 20, other attachments could be made between the rail 11 and a deck (or porch) area including for example, attachments to other portions of the deck beams 21, the deck flooring 22, railing 23, or spindles 24. Other areas of a building would be suitable for attachment, such as a window sill, wall or fence.

Figure 4:
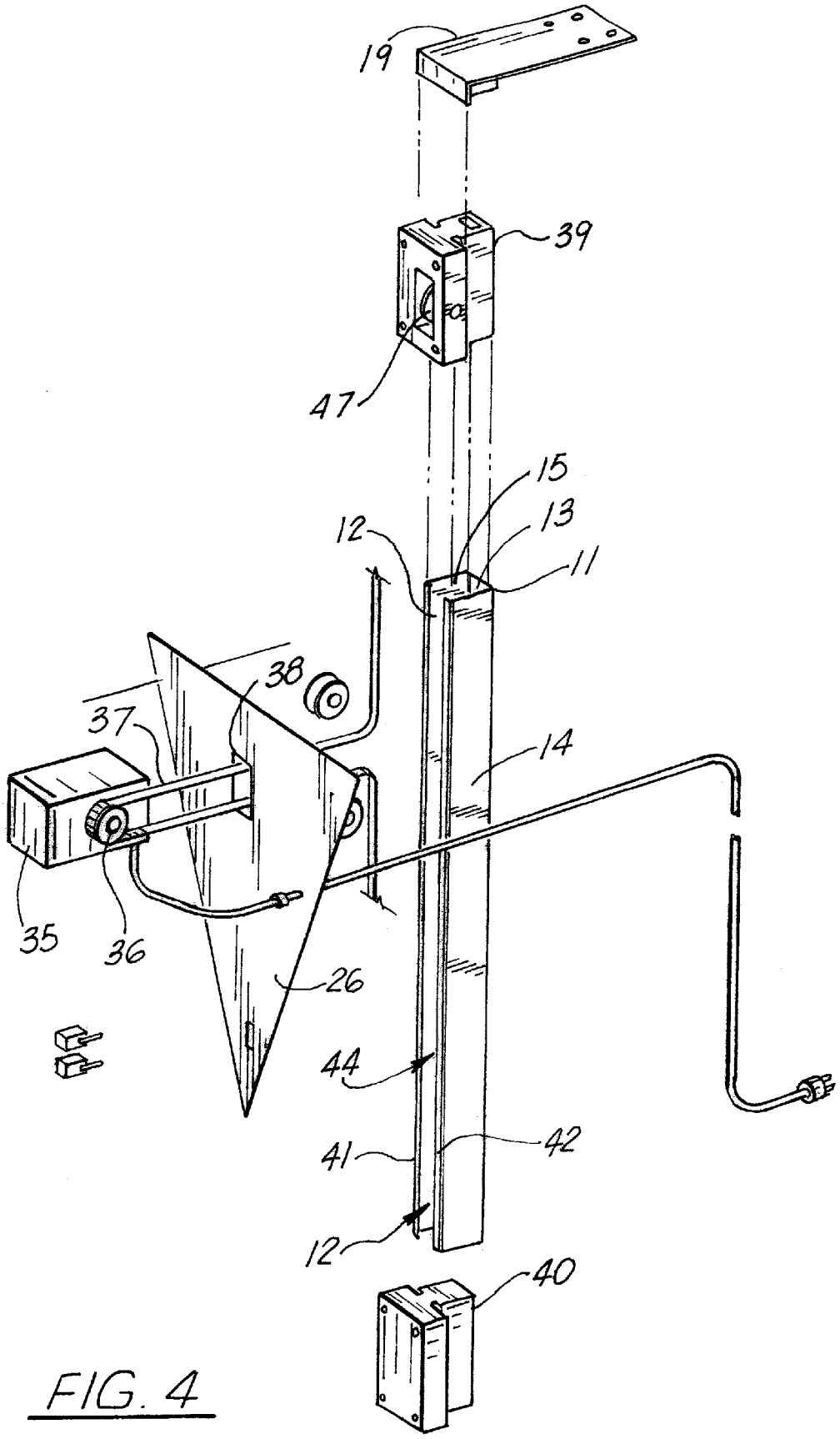
FIG. 4 is a partial, perspective view of the preferred embodiment of the apparatus of the present invention.
Figure 5:
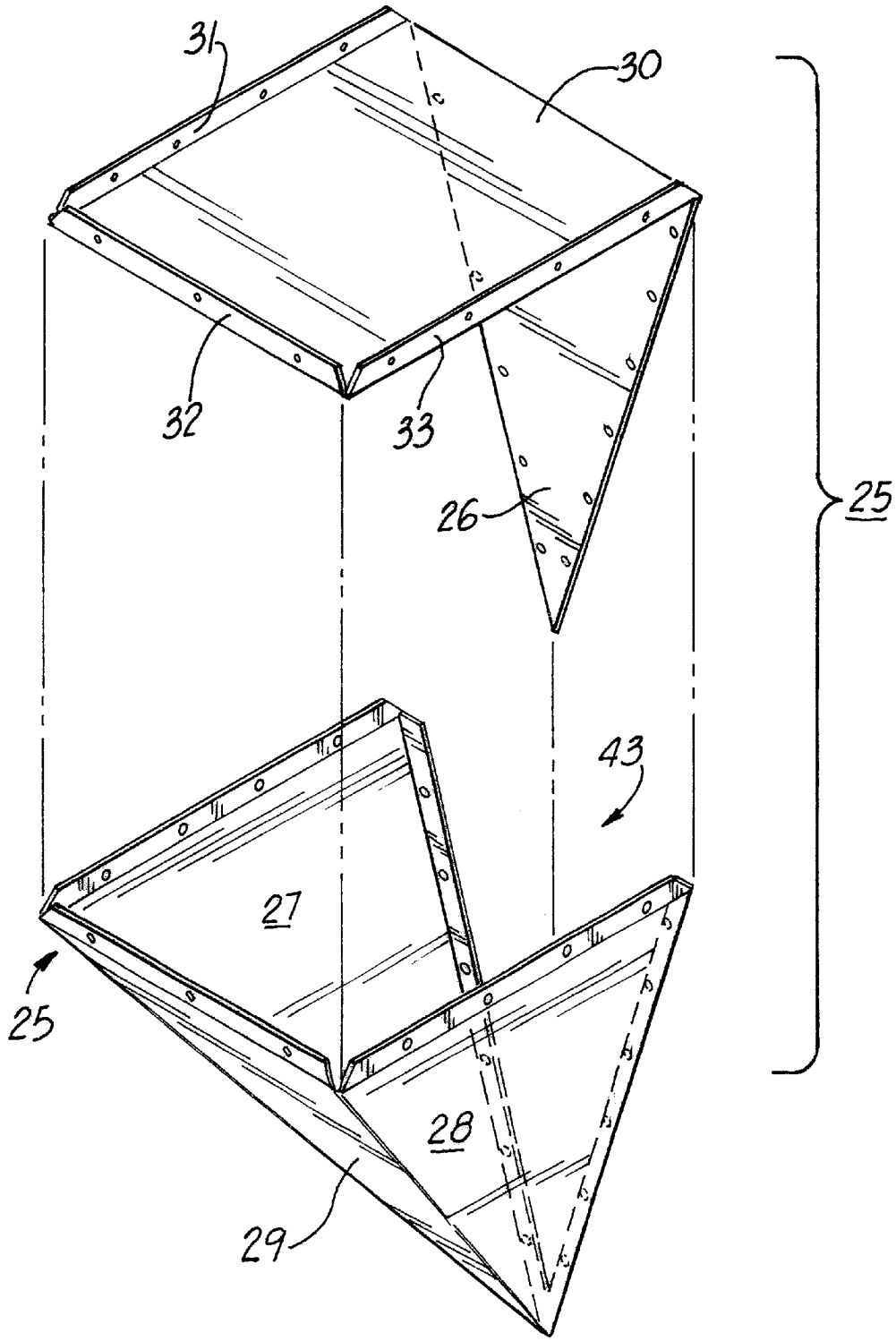
FIG. 5 is another fragmentary, perspective view of the preferred embodiment of the apparatus of the present invention.

Housing 25 is shown in FIGS. 1–3 and more particularly in FIGS. 4–5. Housing 25 includes a rear wall 26 that is generally triangular in shape having a larger upper portion and a smaller lower portion. Rear wall 26 is attached to top panel 30. The combination of top panel 30 and rear wall 26 can be removably connected (eg. bolted) to the remainder of housing 25 comprised of side walls 27, 28 and front wall 29. Side walls 27, 28 can also be triangular in shape. Additionally, front wall 29 spans between the front of side walls 27, 28 as shown in FIG. 5 and is triangular in shape. The use of triangular walls 26, 27, 28, 29 provides a tapered (eg. inverted pyramid) shape that helps push any objects aside that might be inadvertently placed under housing 25 as the housing 25 descends.

In FIG. 5, a top 30 is preferably rectangular or square in shape and with rear wall panel 26 fits the dimensions of the lower portion of the housing defined by side walls 27–28 and front wall 29. The top 30 can be attached integrally to rear wall 26 and then to the walls 26–29 using welded or bolted connections, for example. A removable (eg. bolted) connection is preferable because it enables the housing 25 to be removed for maintenance purposes, giving access to motor drive 35 (see FIGS. 4–5). The top 30 has a plurality of peripheral flanges 31, 32, 33 that extend vertically and which define a rail for containing removable tray 34.

Motor drive 35 is contained within the interior 43 of housing 25. Motor drive 35 can be attached (for example, bolted) to rear wall 26. An opening 38 in rear wall 26 enables belt 37 to extend generally horizontally or laterally from the interior 44 of rail 11 to gear or sprocket 36 of motor drive 35. Belt 37 is anchored or otherwise attached to the upper end portion of rail 11 at anchor 45. Similarly, the belt 37 has a lower end portion that is anchored or otherwise attached to the lower end portion of rail 11 at belt anchor 46.

A pair of slide blocks 39, 40 form an interface between rail 11, motor drive 35, and belt 37. The slider blocks include an upper slider block 39 and a lower slider block 40. Each of the slider blocks provides a pulley that is engaged by belt 37 as shown in FIG. 1. Upper slide block 39 provides pulley 47. Similarly, lower slide block 40 provides a pulley 48 (see FIG. 1).

Power cord 50 transmits electricity to motor drive 35. The power cord 50 can be attached at attachments 49 to the customer's porch or deck area such as, for example, at beam 21 as shown in FIG. 1. The electrical power cord 50 is flexible and is of a length that enables it to provide electricity to motor drive 35 as the motor drive moves upwardly and downwardly the full length of rail 11. A coil type power cord can be used for extended travel.

During use, the motor drive 35 can be operated using either a pushbutton or keypad type control 51 or a remote control 52. Such a pushbutton or keypad (eg. coded) or remote control are each commercially available, such as the devices that are used to operate electrically powered garage doors.

In order to operate the apparatus of the preset invention, a user simply activates the motor drive 35 using either the key panel 51 or remote control 52. Limit switches at 53, 54 define the upper and lower limits of travel of housing 25. Thus, the up and down movement of the housing 25 is analogous to the up and down movement of a garage door. The user simply pushes the remote control 52 in order to either raise or lower housing 25 and its contained packages 55, 56. A torque limit switch will stop if limits fail or are overloaded, preventing damage. When the housing 25 is in a lowermost position as shown in FIG. 1, removable tray can be filled with desired packages 55, 56. The tray 34 is then placed on top 30 of housing 25, as shown by arrow 57 in FIG. 1. The user then operates motor drive 35 and its sprocket or gear 36. The sprocket or gear 36 is wound upon belt 37.

The belt 37 is basically an elongated vertically extending belt that is static within the interior 44 of rail 11. The only part of the belt that moves is that portion which extends laterally through opening 38 to engage sprocket or gear 36 as shown in FIG. 4. The belt thus flexes as it is engaged by sprocket 36. However, the sprocket 36 simply travels upwardly along the 37 until the upper limit switch 53 is engaged, shutting off motor drive 35. This uppermost position is shown in FIG. 3 wherein the user, standing on decking 22, can remove removable tray 34 and its contents such as packages 55, 56, shown in FIG. 3.

Once the packages 55, 56 are unloaded, the tray 34 is returned to top 30. The user then activates remote control 52 or pushbottom keypad control panel 51 so that the housing 25 returns to the lower position. Typically, the housing 25 would be stored in the position shown in FIG. 3 until needed. Thus, an arriving user having packages to unload would activate the remote control 52 to lower the housing 25 to the lower position from its normal stored position (elevated) shown in FIG. 3.

Parts List

The following is a list of suitable parts and materials for the various elements of the preferred embodiment of the present invention.

| PART NO. | DESCRIPTION |
|---|---|
| 10 | lift apparatus |
| 11 | vertical rail |
| 12 | slot |
| 13 | rear flange |
| 14 | side flange |
| 15 | side flange |
| 16 | footing |
| 17 | bottom plate |
| 18 | bolted connection |
| 19 | top support |
| 20 | middle support |
| 21 | deck beam |
| 22 | deck flooring |
| 23 | railing |
| 24 | spindle |
| 25 | housing |

-continued

| PART NO. | DESCRIPTION |
|---|---|
| 26 | rear wall |
| 27 | side wall |
| 28 | side wall |
| 29 | front wall |
| 30 | top |
| 31 | flange |
| 32 | flange |
| 33 | flange |
| 34 | tray |
| 35 | motor drive |
| 36 | gear |
| 37 | belt |
| 38 | opening |
| 39 | upper slide block |
| 40 | lower slide block |
| 41 | front flange |
| 42 | front flange |
| 43 | interior |
| 44 | interior |
| 45 | belt anchor |
| 46 | belt anchor |
| 47 | pulley |
| 48 | pulley |
| 49 | attachment |
| 50 | power cord |
| 51 | pushbutton keypad control panel |
| 52 | remote control |
| 53 | limit switch/stop |
| 54 | limit switch/stop |
| 55 | package |
| 56 | package |
| 57 | arrow |

The foregoing embodiments are presented by way of example only; the scope of the present invention is to be limited only by the following claims.

What is claimed is:

1. A vertically extended loading and unloading apparatus that spans between floors of a building, comprising:

a) a frame that is generally vertically positioned, the frame extending between at least two floors of a building so that articles to be loaded or unloaded between floors can be transported vertically using the frame;

b) a carriage that is movably mounted to the frame, the carriage having an interior and an upper planar load carrying horizontal surface and a plurality of inclined side walls that extend from the load carrying horizontal surface;

c) a motor drive mounted inside the carriage interior;

d) a belt wound upon the motor drive and anchored so that the motor drive elevates the carriage upon the frame when the motor drive is actuated; and e) wherein the belt extends horizontally to engage the motor drive within the carriage interior.

2. The vertically extended loading and unloading apparatus of claim 1 wherein the motor drive provided with a flexible power cable that supplies power to the motor drive.

3. The vertically extended loading and unloading apparatus of claim 1 wherein the carriage has three inclined side walls.

4. The vertically extended loading and unloading apparatus of claim 3 wherein the carriage has three inclined side walls that meet near a common point to define a tapered member that pushes away objects that are under it while it is descending.

5. The vertically extended loading and unloading apparatus of claim 1 wherein the motor drive is an electric motor having a pulley thereon, and the belt engages the pulley.

6. The vertically extended loading and unloading apparatus of claim 1 wherein the frame includes a hollow rail member.

7. The vertically extended loading and unloading apparatus of claim 6 further comprising a slider block that slides inside of the hollow rail, the block being connected for up and down travel with the carriage.

8. The vertically extended loading and unloading apparatus of claim 1 wherein the belt has upper and lower ends, the upper end attached to the top of the frame, the lower end being attached to the bottom of the frame.

9. The vertically extended loading and unloading apparatus of claim 7 wherein there are a pair of slide blocks attached to the carriage, each having a pulley that engages the belt.

10. A vertically extended loading and unloading apparatus that spans between at least two floors of a building, comprising:

a) a rail attached to the building, the rail being generally vertically positioned, the rail extending between at least two floors of a building so that articles to be loaded or unloaded between floors can be transported vertically using the rail;

b) a carriage that is movably mounted to the rail, the carriage having an interior and an upper planar load carrying horizontal surface and a plurality of inclined side walls that extend from the load carrying horizontal surface;

c) a motor drive mounted inside the carriage interior;

d) a belt wound upon the motor drive and anchored so that the motor drive elevates the carriage upon the rail when the motor drive is actuated; and e) wherein the belt extends horizontally to engage the motor drive within the carriage interior.

11. A vertically extended loading and unloading apparatus that spans between floors of a building, comprising:

a) a frame that is generally vertically positioned, the frame extending between at least two floors of a building so that articles to be loaded or unloaded between floors can be transported vertically using the frame;

b) a carriage that is movably mounted to the frame, the carriage having an interior, an upper planar load carrying surface, and a plurality of side walls that extend downwardly from the load carrying horizontal surface;

c) a motor drive mounted within the carriage interior;

d) a belt that is supported at the frame and wound upon the motor drive, the belt being anchored so that the motor drive elevates the carriage upon the frame when the motor drive is actuated; and e) wherein the cable extends laterally to engage the motor drive within the carriage interior.

12. The vertically extended loading and unloading apparatus of claim 11 wherein the motor drive is provided with a flexible power cable that supplies power to the motor drive.

13. The vertically extended loading and unloading apparatus of claim 11 wherein the carriage has three inclined side walls.

14. The vertically extended loading and unloading apparatus of claim 13 wherein the carriage has three inclined side walls that meet near a common point to define a tapered member that pushes away objects that are under it while it is descending.

15. The vertically extended loading and unloading apparatus of claim 11 wherein the motor drive is an electric motor having a pulley thereon, and the belt engages the pulley.

16. The vertically extended loading and unloading apparatus of claim 11 wherein the frame includes a hollow rail member.

17. The vertically extended loading and unloading apparatus of claim 16 further comprising a slider block that slides inside of the hollow rail, the block being connected for up and down travel with the carriage.

18. The vertically extended loading and unloading apparatus of claim 17 wherein there are a pair of slide blocks attached to the carriage, each having a pulley that engages the belt.

19. The vertically extended loading and unloading apparatus of claim 11 wherein the belt has upper and lower ends, the upper end attached to the top of the frame, the lower end being attached to the bottom of the frame.

20. A vertically extended loading and unloading apparatus that spans between at least two floors of a building, comprising:

a) a rail attached to the building, the rail being generally vertically positioned, the rail extending between at least two floors of the building so that articles to be loaded or unloaded between floors can be transported vertically using the rail;

b) a carriage that is movably mounted to the rail, the carriage having an interior, an upper load carrying surface and a plurality of inclined side walls that extend downwardly and inwardly extend toward from the load carrying horizontal surface to define an inverted pyramid shape;

c) a motor drive mounted inside the carriage interior;

d) a belt wound upon the motor drive and anchored to the frame at its end portions so that the motor drive elevates the carriage upon the rail when the motor drive is actuated; and e) the belt having an upper end portion anchored to the upper end portion of the rail and a lower end portion anchored to the lower end portion of the rail.

* * * * *